US005440812A

United States Patent [19]

Nishizuka

[11] Patent Number: 5,440,812

[45] Date of Patent: Aug. 15, 1995

[54] ERRONEOUS CUTTING PREVENTION SCISSORS

[75] Inventor: Umetaro Nishizuka, Oishida, Japan

[73] Assignee: Daikin Denshi Kogyo Co., Ltd., Yamagata, Japan

[21] Appl. No.: 109,047

[22] Filed: Aug. 19, 1993

[30] Foreign Application Priority Data

Aug. 26, 1992 [JP] Japan ..... 4-248863
Mar. 11, 1993 [JP] Japan ..... 5-076438

[51] Int. Cl.[6] ..... B26B 29/00

[52] U.S. Cl. ..... 30/175; 30/90.1; 30/179; 30/233; 30/286; 83/DIG. 1

[58] Field of Search ..... 30/123, 134, 90.1, 179, 30/175, 182, 194, 202, 233, 271, 286; 29/366.4; 83/DIG. 1

[56] References Cited

U.S. PATENT DOCUMENTS 4,112,791 9/1978 Wiener ..... 30/90.1 X
4,272,888 6/1981 Hartmeister ..... 30/233 X
4,983,914 1/1991 Baranski ..... 30/194 X

FOREIGN PATENT DOCUMENTS 1453494 1/1989 U.S.S.R. ..... 30/90.1

*Primary Examiner*—Douglas D. Watts
*Attorney, Agent, or Firm*—Lowe, Price, LeBlanc & Becker

[57] ABSTRACT

Erroneous cutting prevention scissors include an operating member having a shearing blade, another operating member having a receiving portion provided in a closable and separable manner with respect to the shearing blade, and a detecting element for detecting a live condition of an electric wire when the shearing blade is in contact with a conductor of the electric wire. A solenoid is provided which is excited when the detecting means detects the live condition of the electric wire. A first latch mechanism operated by the solenoid is provided on the first operating member, and a second latch mechanism is provided on the other operating member.

12 Claims, 12 Drawing Sheets

ERRONEOUS CUTTING PREVENTION SCISSORS

BACKGROUND OF THE INVENTION

1. Field of the Invention

The present invention, for example, relates to erroneous cutting prevention scissors for cutting electric wires.

2. Related Art And Prior Art Statement

In general, when a pair of electric wires forming a telephoneline are alive, one of the pair of electric wires is earthed, while negative potential, for example, −48V, in the case of the telephone line, is applied to the other electric wire.

When repairing or changing telephone line, it must be prevented to erroneously cut the live electric wires. Conventionally, however, measures for preventing live electric wires from being cut by mistake is such that the electric wires are cut after confirming that they are not alive. For this reason, the conventional method has shortcoming that live wire can be cut if prior checking is not appropriate.

SUMMARY OF THE INVENTION

It is an object of the present invention to provide erroneous cutting prevention scissors in which a shearing blade is capable of detecting whether the electric wire with which the shearing blade is in contact for cutting is alive or not so that the shearing blade is locked to prevent the wire from being erroneously cut if the wire is alive.

It is an another object of the invention to provide erroneous cutting prevention scissors, comprising one of a pair of operating members having a shearing blade, the other operating member having a receiving portion disposed for being capable of both approaching and separating from the sharing blade, detecting means for detecting live electric wire when the shearing blade is in contact with a conductor of the electric wire, a solenoid for exciting the detecting means when the detecting means detects live electric wire, one of latch mechanisms for being operated by excitation of the solenoid, which is provided on one of the operating members, and the other latch mechanism provided on the other operating member, wherein, in cutting a live electric wire, when the shearing blade is in contact with the conductor of the electric wire, the live condition of the electric wire is detected by the detecting means, whereby the solenoid is excited; one of the latch mechanisms provided on the one operating member is operated so that the latch mechanism is engaged with the other latch mechanism provided on the other operating member; and the movement of the shearing blade is prevented before the cutting blade cuts the electric wire, thereby preventing the live electric wire from being erroneously cut.

It is still another object of the invention to provide erroneous cutting prevention scissors, which prevent an electric wire from being cut when it is alive, allows the electric wipe to be cut when it is not alive, judges whether the electric wipe is alive or not by simply operating a pair of operating members fop cutting the electric wire, thereby dispensing with the need of confirming whether or not the electric wipe is alive prior to the cutting of the electric wipe, as well as improving the operating efficiency.

It is a further object of the invention to provide erroneous cutting prevention scissors, wherein an elastic member deformable by a load with respect to a receiving portion of a shearing blade is provided between one of a pair of operating members and the receiving portion; wherein, when an electric wipe is located between the shearing blade of the one operating member and the receiving portion of the other operating member fop being cut, the shearing blade depresses the electric wife, and the electric wipe depresses the elastic member of the receiving portion of the shearing blade, whereby the electric wipe is moved toward the receiving portion; wherein, during movement of the electric wipe, the shearing blade comes into contact with the electric wipe and also comes into contact with a conductor of the electric wife; however, since the electric wipe is moving, the conductor is not cut; wherein, in a case where the electric wipe to be cut is alive, detecting means detects the live condition of the electric wipe, whereby a solenoid is excited; wherein one of a pair of latch mechanisms provided on one of the pair of operating members is operated by excitation of the solenoid to engage with the other latch mechanism which is provided on the other operating member; wherein, after deformation of the elastic member has increased, movement of the shearing blade is surely stopped prior to the cutting of the electric wire by the shearing blade; and wherein, even when the scissors are moved quickly to be operated, the conductor of the electric wire will not instantaneously be cut, so that it is possible to prevent the live electric wire from being erroneously cut.

Erroneous cutting prevention scissors according to the invention comprise one of a pair of operating members having a shearing blade, the other operating member having a receiving portion which is disposed for being capable of both approaching and separating from the shearing blade, detecting means for detecting a live condition of the electric wipe when the shearing blade is in contact with a conductor of the electric wire, a solenoid for exciting the detecting means when the detecting means detects the live condition of the electric wire, one of latch mechanisms, which is operated by excitation of the solenoid provided on the one operating member, and the other latch mechanism provided on the other operating member.

BRIEF DESCRIPTION OF THE DRAWINGS

FIG. 9 is a view in which FIG. 7 is viewed from a direction of an arrow D—D;

FIG. 11 is a view in which FIG. 7 is viewed from a direction of an arrow F—F—F;

FIG. 12 is a view in which FIG. 7 is viewed from a direction of an arrow G—G;

DETAILED DESCRIPTION OF THE PREFERRED EMBODIMENTS

Figure 1:
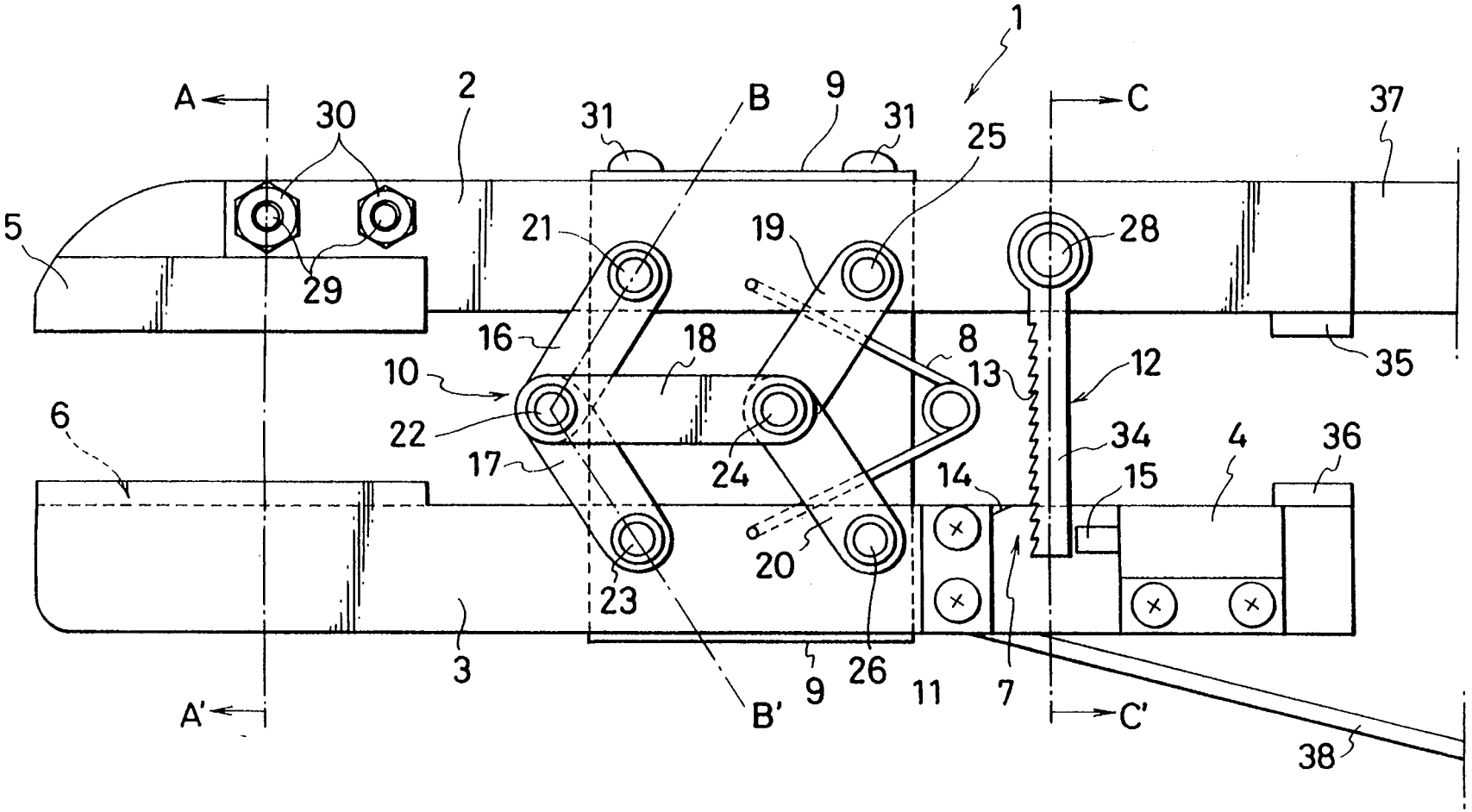
FIG. 1 is a front elevator view of erroneous cutting prevention scissors according to a first embodiment of the invention.
Figure 2:
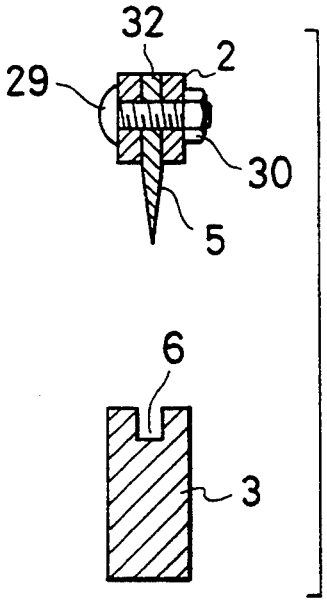
FIG. 2 is a cross-sectional view taken along a line A–A′ in FIG. 1.

FIG. 1 shows a first embodiment of erroneous cutting prevention scissors according to the invention. A scissor body 1 is provided with an operating member 2 on which a shearing blade 5 is mounted, and an operating member 3 having a receiving groove 6 which is provided in parallel with and for being capable of both approaching and separating from the shearing blade 5. As shown in FIG. 2, at one end of the operating member 2, the shearing blade 5 has a tip directed toward the operating member 3, and a root of tooth of the shearing blade 5 is put between portions of a clamping section 32 which is formed between portions of the operating member 2. The shearing blade 5 is mounted by bolts 29 and nuts 30. Further, the receiving groove 6 which is opposed to the tip of the shearing blade 5 to receive the same is provided at one end of the operating member 3 on the side of the operating member 2. Each of the operating members 2 and 3 has configuration extending along a longitudinal direction along which the shearing blade 5 and the receiving groove 6 are provided.

In connection with the above, although not shown in FIG. 1, detecting means for detecting a live condition of an electric wire at the time when the shearing blade 5 is in contact with a conductor of the electric wire connected to the shearing blade 5.

Operating members 2 and 3 are connected to each other, at the middle points in their longitudinal directions, with a parallel ling mechanism 10, which is provided for not only moving the operating members 2 and 3 parallelly to each other but also for enabling them to approach and separate from each other. A torsion coil spring 8 is provided to connect the opposing insides of the operating members 2 and 3. A stopper 9 is provided containing the outsides of the operating members 2 and 3 to keep constant the interval between the members 2 and 3 against the biasing force of the torsion spring 8.

Figure 3:
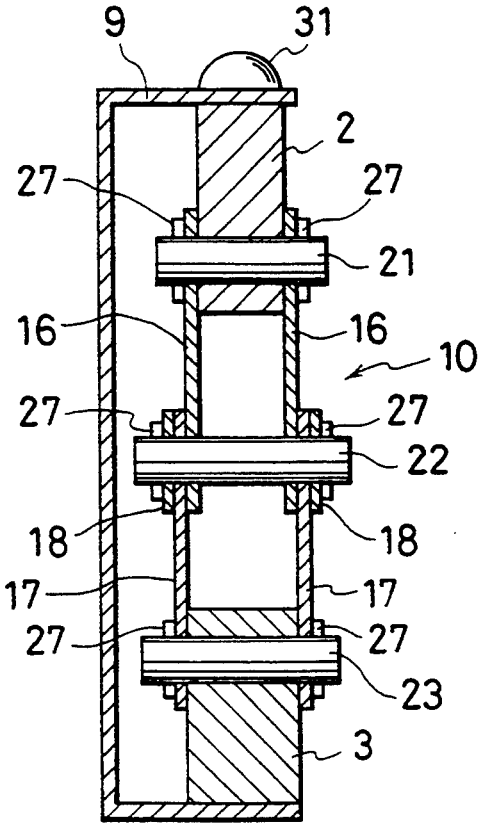
FIG. 3 is a cross-sectional view taken along a line B–B′ in FIG. 1.

As shown in FIG. 3, the parallel link mechanism 10 is provided symmetrically containing front sides and rear sides of the operating members 2 and 3 with respect to plane. Links 16 and 16 have respective one ends thereof which are mounted by a pin 21 at the front side and the rear side of the operating member 2. At outsides of the respective links 16 and 16, links 17 and 17 have respective one ends thereof which are mounted on the front side and the rear side of the operating member 3 by a pin 23. Furthermore, as shown in FIG. 1, links 19 and 19 are provided in parallel to each other on an extension of the operating member 2 in a longitudinal direction with respect to a position where the links 16 and 16 are axially mounted. Links 20 and 20 are provided in parallel relation to each other on the extension of the operating member 2 in the longitudinal direction with respect to a position where the links 17 and 17 are axially mounted. The links 19 and 19 have respective one ends thereof which are axially mounted on a pin 25 with respect to the operating member 2. The links 20 and 20 have respective one ends thereof which are axially mounted on a pin 26 with respect to the operating member 3.

The other ends of the respective links 16 and 16, the other ends of the respective links 17 and 17 and one ends of respective links 18 and 18 are axially mounted on a pin 22. The other ends of the respective links 19 and 19, the other ends of the respective links 20 and 20 and the other ends of the links 18 and 18 are axially mounted on a pin 24. Accordingly, the links 16 and 16 and the links 17 and 17, the links 19 and 19, and the links 20 and 20 are connected to each other by the links 18 and 18.

The links 18 and 18 are positioned in parallel and intermediately to the longitudinal direction of each of the operating member 2 and the operating member 3. A longitudinal direction of each of the links 16 and 16 and the links 17 and 17 and a longitudinal direction of each of the links 19 and 19 and the links 20 and 20 intersect with each other, facing toward a direction of the one ends of the respective operating members 2 and 3. Each of the pins 21, 22, 23, 24, 25 and 26 has both ends axially supported by retaining rings 27.

The presser member 9 is made of a plate-like member both sides of which are bent perpendicularly. One of the sides of the presser member 9 is fixedly mounted on an outside surface of the operating member 2 by a pair of screws 31 and 31. The presser member 9 has a planar-plate portion located at opposite sides of the respective operating members 2 and 3. The other side surface of the presser member 9 abuts against the outside surface of the operating member 3. The presser member 9 maintains the spacing between the operating member 2 and the operating member 3 constant against the biasing force of the aforesaid torsion coil spring 8 acting from insides toward outsides of the respective operating members 2 and 3, by the side surface of the presser member 9 abutting against the outside surface of the operating member 3.

In FIG. 1, a latch mechanism 7 comprising an engaging member 12 with a serrated portion 13 and a receiving member 11 with a pawl 14 to engage with the serrated portion 13 of the engaging member 12 is provided laterally to the parallel link mechanism 10 and near the proximal ends of the respective operating members 2 and 3.

Figure 4:
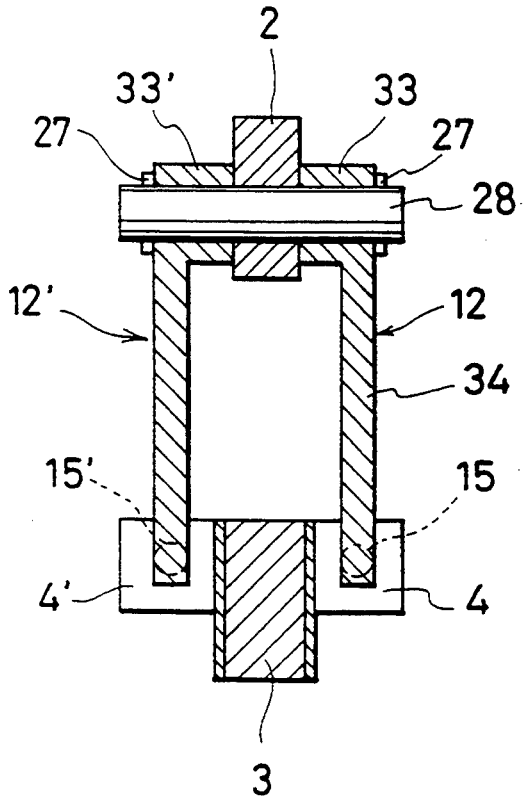
FIG. 4 is a cross-sectional view taken along a line C–C′ in FIG. 1.

As shown in FIG. 4, the engaging members 12 and 12′ are similarly provided opposite to each other on the front sides and back sides of the respective operating member 2 and 3. The engaging member 12 has one end thereof formed with a tubular inserting portion 33. The engaging member 12 has a rod-like portion 34 extending in a direction intersecting with an axis of the inserting portion 33 therefrom. The setration 13 is provided on one of longitudinal edges of the rod-like portion 34. A pin 28 is inserted into the operating member 2 from its front surface side to the opposite side. The operating member 2, disposed between the engaging member 12 having its pin-inserting portion 33 and the engaging member 12, having a configuration similar to that of the engaging member 12, is inserted with the pin 28 from the direction of the front side of the operating member 2 through the pin-inserting portions 33 and 33', in order to axially mount the serrated portions 13 and 13' respectively facing towards the from end of the operating member 2. The pin 28 has its front ends stopped with retaining rings 27 respectively.

The pair of receiving members 11 and 11' are screwed respectively to opposing outsides of the operating member 3, with the pair of pawls 14 and 14' facing respectively toward the serrations 13 and 13' of the respective engaging members 12 and 12'.

Further, a pair of solenoids 4 and 4', having mounted respectively therewithin a pair of operating rods 15 and 15' which project towards opposite sides of the serrations 13 and 13' of the rod-like portions 34 of the respective engaging members 12 and 12', are screwed respectively to both the front side the opposite side of the operating member 3.

The engaging members 12 and 12' are arranged in such a manner that the solenoids 4 and 4' are excited to cause the pair of operating rods 15 and 15' to project, whereby surfaces of the rod-like portion 34 opposite to the serrations 13 and 13' are pressed to be moved angularly toward the receiving members 11 and 11', so that the setrations 13 and 13' are engaged respectively with the pawis 14 and 14' of the respective receiving members 11 and 11'.

Stoppers 35 and 36, for stopping the operating members 2 and 3 at a position where the shearing blade 5 and the receiving groove 6 meet with each other when scissors body 1 is operated for cutting, are provided respectively on the inner side of the operating member 2 and on the inner side of the operating member 3. The other end of the operating member 2 is formed with a gripper 37. A gripper 38, which extends outwardly towards the other end of the operating member 3, is mounted midway on the outside surface of the operating member 3.

In the following, only a front side of the scissors body 1 will be described, since the front side and the opposite side of the scissors body 1 are symmetrical with each other with respect to plane.

When the scissors body 1 is operated so that the gripper 37 at the other end of the operating member 2 and the gripper 38 of the operating member 3 come closer to each other or are moved toward each other by a hand, each of one ends of links 16, 17, 19 and 20 is pushed inward between the operating members 2 and 3, since each of one ends of the links 16 and 19 of the parallel link mechanism 10 are axially mounted on the operating member 2 by the pins 21 and 25, each of one ends of the links 17 and 20 is axially mounted on the operating member 3 by the pins 25 and 26, each of one ends of the links 16 and 19 is axially mounted on the one end of the link 18, and each of the other ends of the respective links 16 and 19 is axially mounted on the other end of the link 18.

The other ends of the links 16 and 17 and the other ends of the links 19 and 20 simultaneously urge both ends of the link 18 toward the forward ends of the operating members 2 and 3. This causes the link 18 to be moved toward the forward end direction, whereby the operating members 2 and 3 are moved inwardly to come closer with each other.

The operating member 2 and the operating member 3 are moved inward, whereby the torsion coil spring 8, both the acting ends of which are mounted on the inside of the operating member 2 and the inside of the operating member 3, are deformed. One of the side surfaces of the presser member 9 is fixedly mounted on the operating member 2, while the other side surface is only abutted against the outward surface of the operating member 3, so that the operating member 3 is allowed to separate from the presser member 9.

When cutting the electric wire, the electric wire is positioned so as to cross the shearing blade 5 between the shearing blade 5 of the operating member 2 and the receiving groove 6 in the operating member 3. Then, the scissors body 1 is operated by a hand so that the gripper 37 of the operating member 2 and the gripper 38 of the operating member 3 come closer to each other to move the operating member 2 and the operating member 3 inward so that the operating member 2 and the operating member 3 come closer to each other until the shearing blade 5 and the receiving groove 6 meet with each other to cut the electric wire.

After cutting, when the gripper 37 of the operating member 2 and the gripper 38 of the operating member 3 is released from squeeze by a hand, the operating member 2 and the operating member 3 are forced to separate from each other until the outside surface of the operating member 3 comes to abut against the other side surface of the presser member 9 due to the biasing force acting outward from the inside of the operating member 3 resulting from the deforming return of the torsion coil spring 8, so that the space between the operating member 2 and the operating member 3 is maintained constant between the side surfaces of the operating member 9.

Figure 6:
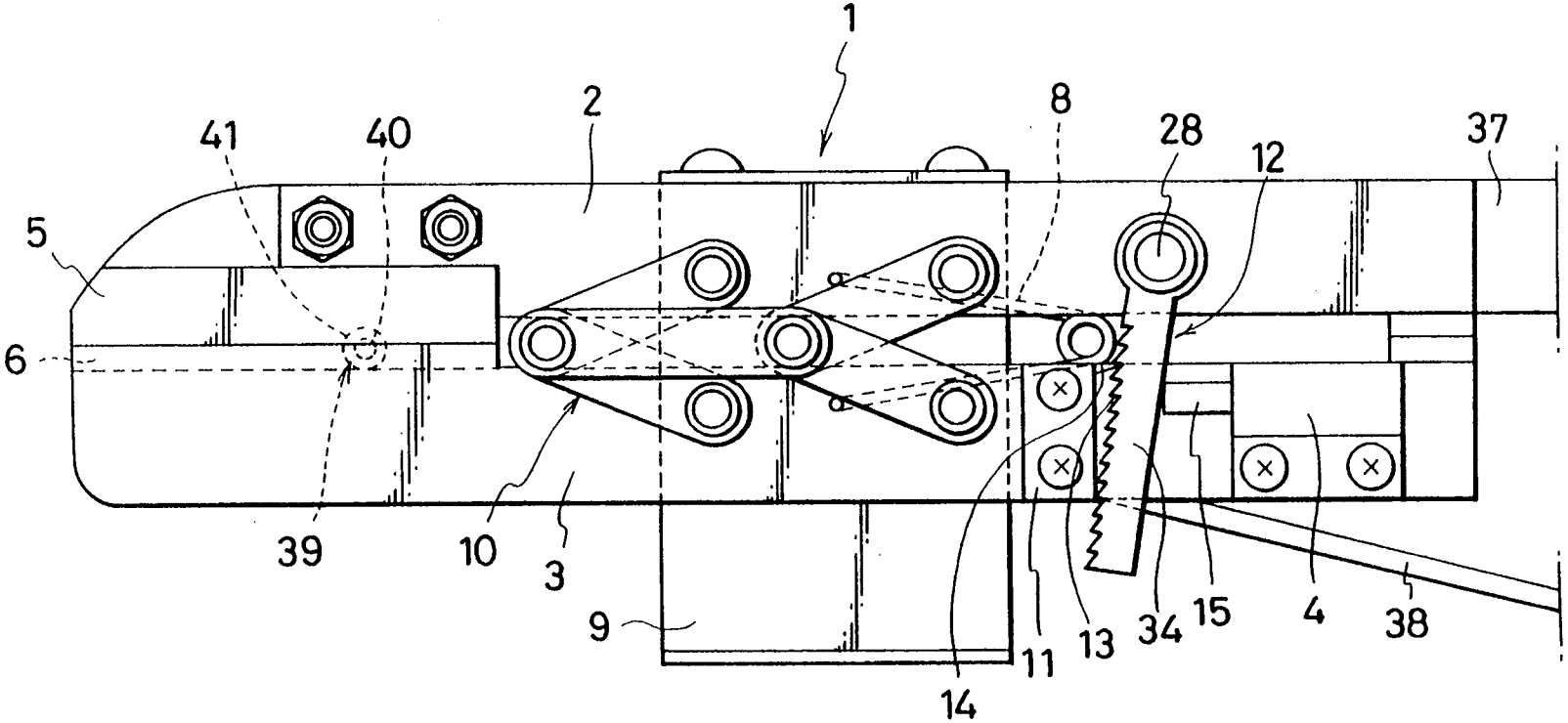
FIG. 6 is a front elevational view showing an operative condition of a latch mechanism in the erroneous cutting prevention scissors.

When the electric wire to be cut is alive, as shown in FIG. 6, when the shearing blade 5 cuts a sheath 41 of an electric wire 39 until coming into contact with a conductor 40, the solenoid 4 is excited to project the operating rod 15. This causes one side of the rod-like portion 34 of the engaging member 12, which is opposite to the serration 13, to be pressed by the operating rod 15. Thus, the engaging member 12 is moved angularly toward the receiving member 11 to cause the serration 13 to engage with the pawl 14 of the receiving member 11. The mutual approach and movement of operating member 2 and the operating member 3 are limited by the engagement between the pin 28 on which the engaging member 12 is axially mounted and the pawl 14, thereby previously preventing the shearing blade from moving to prevent the live electric wire 39 from being cut.

In the present embodiment, the configuration of the setration 13 of the engaging member 12 of the latch mechanism 7, which is provided on the front side and opposite side the operating member 2, is the same as the configuration of the serration 13' of the engaging member 12' of the latch mechanism 7, which is provided on the front side and opposite side of the operating member 3. However, the setration 13 on the front side and the serration 13' on the opposite side may be shifted from each other by a half pitch.

The receiving portion of the operating member 3 may be the same in configuration as the shearing blade 5 in substitution for the receiving groove 6, like the case of conventionally known scissors.

Figure 5:
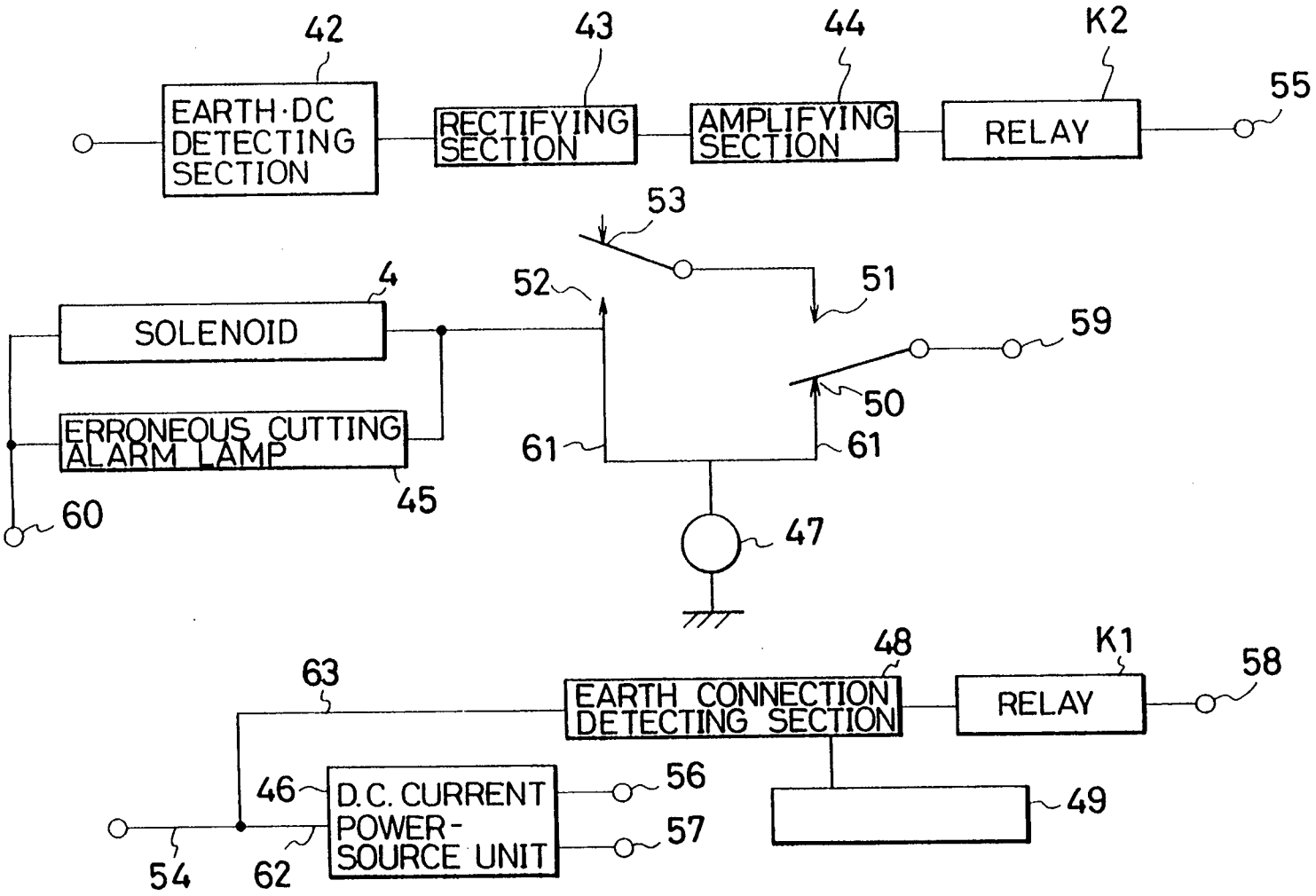
FIG. 5 is a block diagram showing a principal portion of an electrical system of the erroneous cutting prevention scissors.

FIG. 5 is a block diagram showing an electric system of the erroneous cutting prevention scissors according to the embodiment of the invention.

An earth-DC detecting portion 42 for detecting the live condition of the electric wire at the time the shearing blade 5 is in contact with the conductor of the electric wire is connected to a relay K2 through a rectifying portion 43 and an amplifying portion 44. Positive voltage is applied to the relay K2 through a terminal 55.

Moreover, an electric power cord 54 connected to interior wiring is divided into two. One of signal lines 62 passes through a direct-current power-source unit 46. Thereafter, the positive voltage is applied to the one signal line 62 at a terminal 56, and negative voltage is applied at a terminal 57. Furthermore, the other signal line 63 of the power cord is connected to an earth connection detecting portion 48. The earth connection detecting portion 48 is connected to a relay K1. The positive voltage is applied to the relay K1 through a terminal 58. Further, the earth connection detecting portion 48 is connected to an earth clamping contact 49.

Moreover, a terminal 60 is connected to the terminal 57 so that the negative voltage is applied to the terminal 60. The solenoid 4 for activating the latch mechanism 7 in FIG. 1 and an erroneous cutting alarm LED 45 are connected in parallel to the terminal 60. Each of the solenoid 4 and the erroneous cutting alarm LED 45 is connected to a terminal 59 through a relay contact 52 and a relay contact 51. The positive voltage is applied to the terminal 59. Furthermore, one of signal lines 61 is connected to a relay contact 50, while the other signal line 61 is connected to the relay contact 52. Further, the signal line 61 is connected to the earth through an alarm buzzer 47.

The relay contacts 50 and 51 are contacts of the relay K1, and switching is made to the side of the relay contact 51 when the relay K1 is activated. The relay contacts 52 and 53 are contacts of the relay K2. The relay contact 53 is normally open, and switching is made to the side of the relay contact 52 when the relay K2 is activated.

Operation of the electric system of the erroneous cutting prevention scissors according to the present embodiment will be described next.

First, the earth clamp contact 49 is connected to the earth. By doing so, the earth connection detecting portion 48 is connected to the earth by the earth crocodile contact 49.

When the electric cord 54 is inserted into and is connected to the interior wiring, alternate 100 V is supplied to the direct-current power-source unit 46 through the signal line 62. The direct-current power-source unit 46 applies the positive voltage to the terminal 56, and applies the negative voltage to the terminal 57.

Further, the alternate 100 V is supplied to the earth connection detecting portion 48 through the signal line 63. Voltage between the earth and the alternate 100 V is applied to the earth connection detecting portion 48 to activate the relay K1. When the relay K1 is activated, the relay contact 51 is to the terminal 59.

When the power cord 54 is inserted into the interior wiring to be connected thereto without earth connection of the earth clamp contact 49, the earth connection detecting portion 48 is not connected to the earth by the earth crocodile contact 49. Accordingly, the relay K1 is not activated. The relay contact 50 is connected to the signal line 61. Current flows through the alarm buzzer 47 which is grounded by the terminal 59 through the signal line 61. Thus, the alarm buzzer 47 sounds to give alarm.

Next, operation of the erroneous cutting prevention scissors will be described as to a case where the earth crocodile contact 49 is connected to the earth; the power-source code 54 is inserted into the interior wiring; and the relay contact 51 is conducted.

In cutting the live electric wire, which is normally applied with −48 V or 0 V, when the shearing blade 5 is in contact with the conductor of the electric wire, the earth DC detecting portion 42 detects the live condition of the electric wire to output a signal. The signal outputted by the earth DC detecting portion 42 is rectified by the rectifying portion 43, and is amplified by the amplifying portion 44, to activate the relay K2. When the relay K2 is activated, the relay contacts 52 and 53 are connected to each other.

For this reason, the current flows to the solenoid 4 through the terminal 59, the relay contact 51, and the relay contacts 53 and 52, and to the terminal 57 of the direct-current unit 46 through the erroneous cutting alarm lamp 45 and the terminal 60. Thus, the solenoid 4 is excited to activate the latch mechanism 7, and the erroneous cutting alarm lamp 45 is turned on. Then, the current flows through the alarm buzzer 47 which is grounded through the terminal 59, the relay contact 51, the relay contacts 53 and 52 and the signal line 61 so that the alarm buzzer 47 is sounded to give an alarm.

When the electric wire is not alive, even if the shearing blade 5 is in contact with the conductor of the electric wire, the earth DC detecting portion 42 does not output the signal. Accordingly, the relay K2 is not activated, and the solenoid 4 is not excited either. Thus, the latch mechanism 7 is not activated, and the electric wire is cut.

Figure 7:
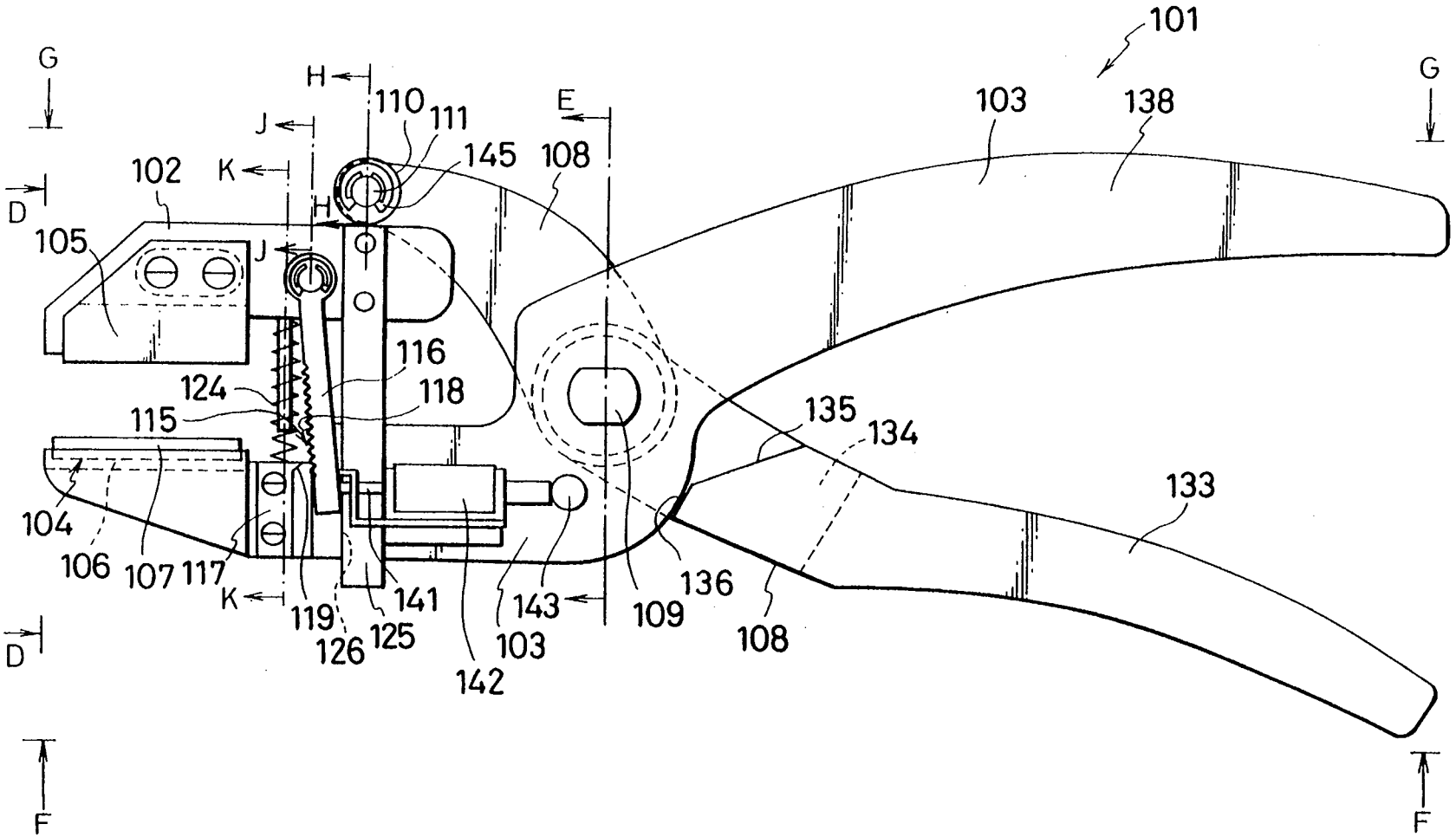
FIG. 7 is a front elevational view of erroneous cutting prevention scissors according to a second embodiment of the invention.

FIG. 7 is a front elevational view showing a second embodiment of the erroneous cutting prevention scissors according to the invention. A scissors body 101 is provided with an operating member 102 on which a shearing blade 105 is mounted, an operating member 103 having a receiving portion 104 which receives the shearing blade 105, and a lever 108 for moving the operating member 102, on which the shearing blade 105 is mounted, in a direction for approaching the operating member 103 which has the receiving portion 104. The lever 108 and the operating member 103 intersect with each other at about their respective intermediate points so that a bolt 109 can be inserted through the intersecting point, whereby the lever 108 and the operating member 103 are movable angularly round the bolt 109. The shearing blade 105 is disposed in parallel to the receiving portion 104 in a closable and separable manner with respect to receiving portion 104.

Figure 8:
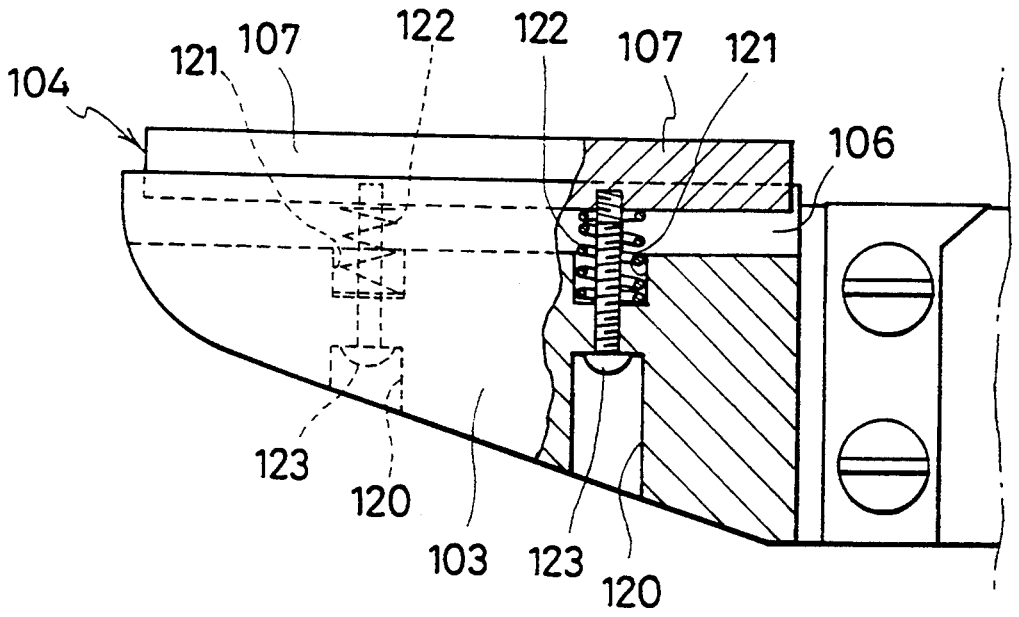
FIG. 8 is a front elevational view showing, in cross-section, a part of a receiving portion in the second embodiment.
Figure 9:
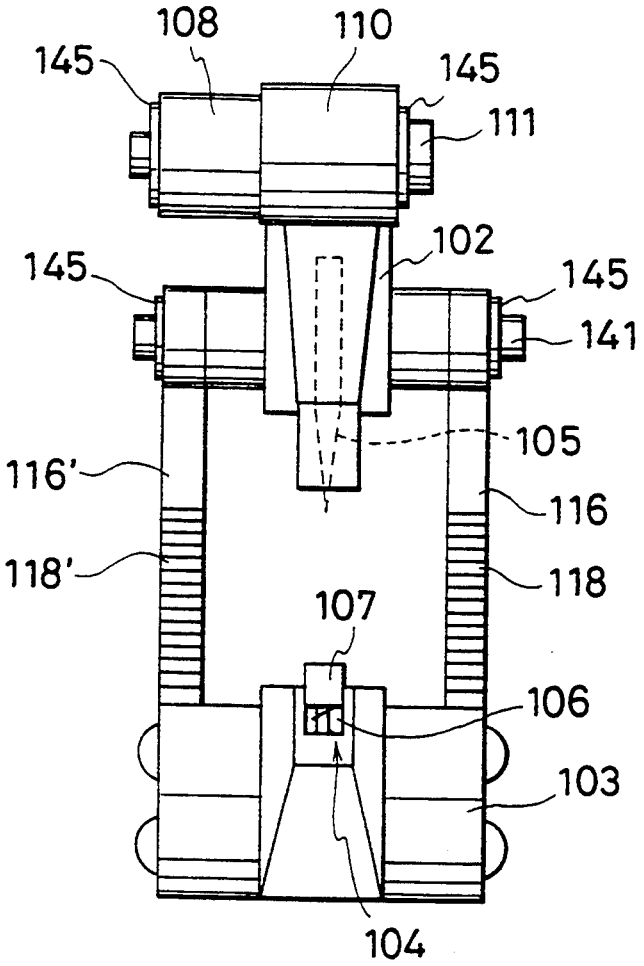

The shearing blade 105 is mounted in such a manner that an edge is directed inwardly and toward the receiving portion 104, and a root of blade is screwed to a portion thereof ranging from the middle of the operating member 102 towards the front end thereof. Further, the receiving portion 104 for receiving the opposing edge of the shearing blade 105 is provided ranging towards the forward end of the operating member 103. As shown in FIGS. 7 and 8, the receiving portion 104 has a receiving groove 106 extending along a blade direction of the shearing blade 105 provided on the inside of the receiving portion 104. Moreover, as shown in FIG. 8, a threaded bore for screwing and a pair of recesses 120 and 120 are provided on the outside of the receiving portion 104.

As shown in FIG. 8, a pair of spring retainers 121 and 121 are provided as recess within the receiving groove 106. Elastic members consisting of coil springs 122 and 122 have respective one ends thereof fitted respectively in the spring retainers 121 and 121. The coil springs 122 and 122 have the respective other ends thereof at which elastic plates consisting of a synthetic resin plate 107 such as bakelite or the like are arranged. The synthetic resin plate 107 is mounted on the inside of the operating member 103 by driving the forward ends of respective screws 123 and 123 thereinto passing through the recesses 120 and 120 and the coil springs 122 and 122 on the outer side of the operating member 103.

Thus, the synthetic resin plate 107 is arranged so that its surface for receiving the shearing blade 105 projects toward the shearing blade 105 from a surface on the inside of the operating member 103 by biasing forces of the respective coil springs 122 and 122. Furthermore, the biasing forces of the coil springs 122 and 122 are of such order that the synthetic resin plate 107 is moved backward within the receiving groove 106 by a load of the shearing blade 105.

In the present embodiment, the coil springs 122 and 122 are used as elastic members which is to be deformed by the load of the shearing blade 105 on the operating member 103. However, similar function can be obtained if an elastic-material cushion made of neoprene rubber or the like is provided under the synthetic resin plate 107 as substitute for the coil springs 122 and 122.

Although not shown in FIG. 7, the shearing blade 105 is connected to detecting means for detecting a live condition of the electric wire at the time the shearing blade 105 is in contact with the conductor of the electric wire.

Figure 11:
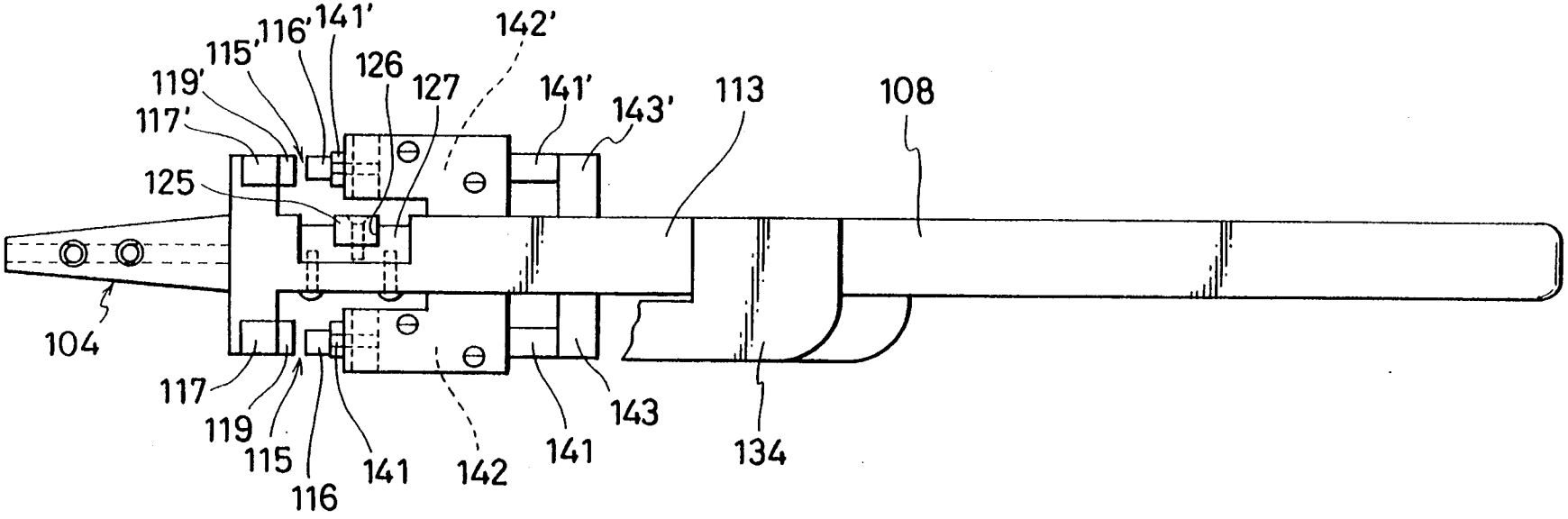

A coil spring 124 is installed on a surface of the operating member 102, which is opposite to the operating member 103. Moreover, a guide rod 125 is mounted by screwing on one side of operating member 102 adjacent to its rearward end in parallel with an axis of the coil spring 124. As shown in FIG. 11, a guide member 127 having a guide groove 126 for guiding a guide rod 125 is mounted on the operating member 103 by screwing.

As shown in Fig, 15, a spring retainer 128 is provided on the side of the operating member 102 facing the operating member 103. A threaded bore 130 is provided on the inside of the spring retainer 128. A spring retainer 129 is provided on the side of the operating member 103 facing the operating member 102. A guide bore 131 is provided on the inside of the spring retainer 129. A support rod 132 has one end screwed into the threaded bore 130 in the operating member 102. The other end of the support rod 132 projects to a location between the operating member 102 and the operating member 103. A coil spring 124 is inserted over the support rod 132 from the side where the support rod 132 projects. The coil spring 124 has one end fitted into the spring retainer 128 of the operating member, while the other end of the coil spring 124 is fitted into the spring retainer 129 of the operating members 102 and 103.

The guide rod 125 mounted on the operating member 102 is guided by the guide groove 126 in the guide member 127 of the operating member 103. The operating member 102 and the operating member 103 are held at a neutral position with a fixed interval kept by the biasing force of the coil spring 124 mounted therebetween. The guide rod 125 is guided by the guide groove 126 in the guide member 127, whereby the operating member 102 and the operating member 103 are controlled for their respective positions.

The operating member 102 is moved in parallel to the operating member 103 by the lever 108, whereby the shearing blade 105 is moved toward the receiving portion 104 to cut the electric wire put between the shearing blade 105 and the receiving portion 104.

The lever 108 is such that the roller 110 is axially supported, for its angular movement, on one side of its forward end. The bolt 109, that is an angularly movable fulcrum of the scissors body 101, is inserted into the lever 108 at about its middle, rather closer to the forward end, of the same, and a gripper 133 is provided rather close to its rearward end.

Figure 12:
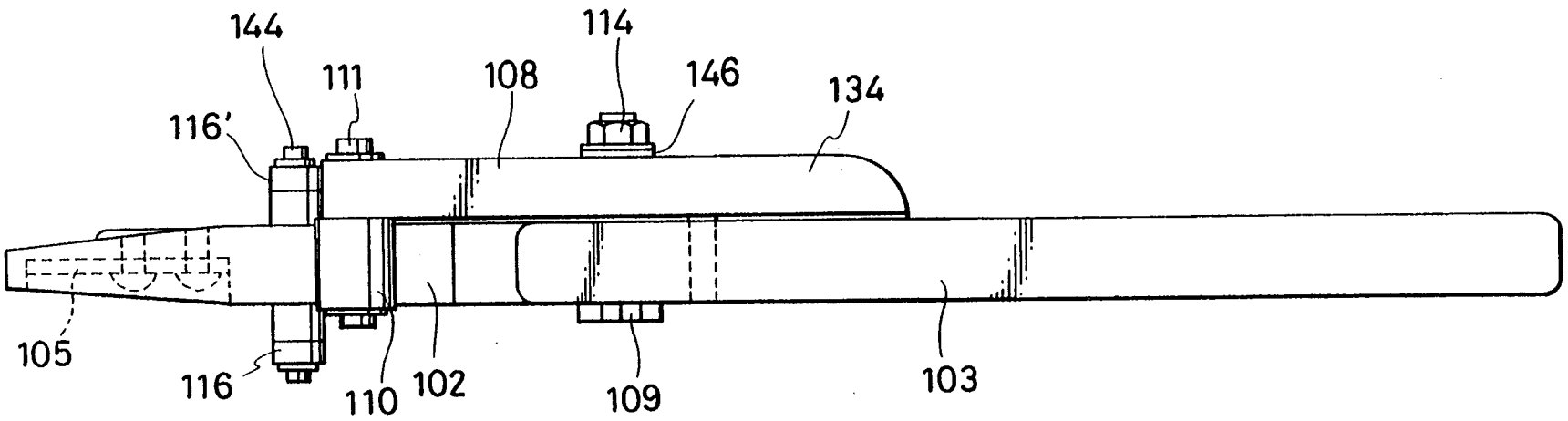

As shown in FIG. 11 and FIG. 12, the lever 108 has a bent portion 134 integrally formed therewith curving toward one side of the lever 108 ranging from the longitudinal middle thereof to the forward end thereof. As shown in FIG. 7, the lever 108 has a step 135 with respect to the gripper 133 on the bent portion 134; the operating member 103 is mounted intersecting with and abutting against the step 135. The step 135 has its forward end forming a stopper 136 abutting against the side of the operating member 103 to determine an opening angle of the scissors body 101. Further, the step 135 has its rearward portion inclined toward the rearward end of the lever 108 to provide a clearance necessary when the scissor body 101 is closed.

Figure 13:
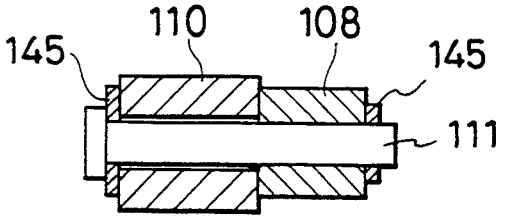
FIG. 13 is a cross-sectional view taken along a line H—H in FIG. 7.

A shaft pin 111 is inserted perpendicularly in a longitudinal direction of the lever 108. As shown in FIG. 13, the roller 110 has the shaft pin 111 inserted therethrough. The shaft pin 111 has both ends respectively fitted with E-rings 145 and 145, whereby the roller 110 is axially supported for being angularly movable on one side of the forward end of the lever 108.

Figure 10:
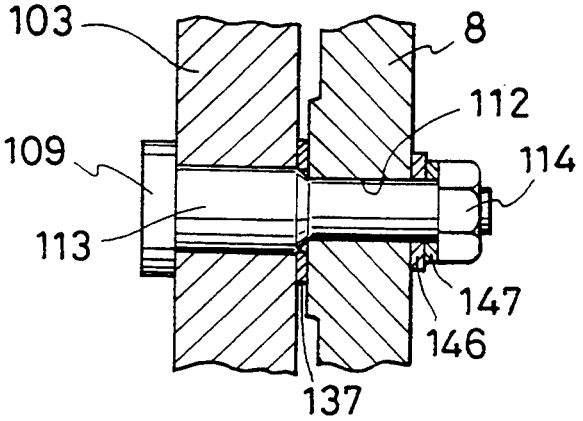
FIG. 10 is a cross-sectional view taken along a line E—E in FIG. 7.

The lever 108 and the operating member 103 are disposed to intersect with each other at about the respective middles of the lever 108 and operating members 103, rather closer to their forward ends, so that the bolt 109 is inserted thereinto, whereby the lever 108 and the operating member 103 are mounted for being angularly movable with the bolt 109 serving as the shaft. As shown in FIG. 10, the bolt 109 has its diameter of forward end portion being smaller than that of the proximal end portion.

A bolthole 112 coincident with the cross-sectional configuration of the diameter-reduced portion on the side of the forward end of the bolt 109 is formed at about the middle, rather closer to the forward end side, of the lever 108, while a bolt inserting bore 113 coincident with the cross-sectional configuration of the proximal end side of the bolt 109 is formed in about the middle of the operating member 103.

The lever 108 and the operating member 103 are made to intersect with each other to be mounted for being angularly movable and axially round the bolt 9 by that the bolt 109 is inserted through in the order of the bolthole 113 of the operating member 103, washer 137 and bolthole 112 of the lever 108, while the nut 114 is screwed on the bolt 109 through the washers 146 and 147 from the side of lever 108. Simultaneously, as shown in FIGS. 7 and 12, the roller 110 at the forward end of the lever 108 abuts against the outside of the operating member 102.

As shown in FIG. 7, the operating member 103 is provided, adjacent to the forward end thereof, with the receiving portion 104 for receiving the shearing blade 105, and curved, at about its middle, perpendicularly to its longitudinal direction. Further, the rearward side of the operating member 103 is curved in the longitudinal direction. A gripper 138 is provided adjacent to the rearward end of the operating member 103.

Latch mechanisms 115 and 115' are arranged respectively on both side surfaces of the operating member 102 and the operating member 103. The latch mechanisms 115 and 115' comprise engaging members 116 and 116 having setrations 118 and 118', respectively, and the receiving members 117 and 117' having pawls 119 and 119' respectively for engaging with the setrations 118 and 118'.

Figure 14:
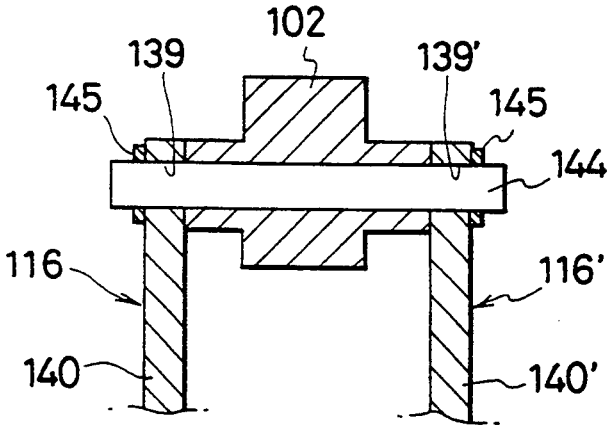
FIG. 14 is a cross-sectional view taken along a line J—J in FIG. 7.

As shown in FIG. 14, the engaging members 116 and 116' have respective one ends formed therein with insertion bores 139 and 139'. The engaging members 116 and 116' have rod-like portions 140 and 140' extending in a direction respectively intersecting with axes of the insertion bores 139 and 139'. The rod-like portions 140 and 140' have longitudinal side edges including setrations 118 and 118'. As shown in FIG. 14, a pin 144 is inserted into the operating member 102. The engaging members 116 and 116' are disposed at respective both end surfaces of the operating member 102 by being inserted with the pin 144 through the insertion bores 139 and 139'. The serrations 118 and 118' are made to face toward the forward end of the operating member 102, that is, toward a side on which the shearing blade 105 is mounted by axially mounting the engaging members 116 and 116' on the operating member 102. E-rings 145 and 145 are fitted on both ends of the pin 144 respectively to prevent the pin from falling off.

As shown in FIG. 11, the receiving members 117 and 117', comprising the respective pawis 119 and 119 thereof for respectively engaging with the serrations 118 and 118' of the engaging members 116 and 116', are screwed to the operating member 103, facing towards the gripper 138.

Solenoids 142 and 142' are respectively screwed to both sides of the operating member 103. Operating rods 141 and 141' are installed respectively within the solenoids 142 and 142' on the side of the gripper 138 of the engaging members 116 and 116'. The operating rods 141 and 141' project respectively toward side edges of the rod-like portions 140 and 140' of the engaging members 116 and 116', the sides being opposite to the serrations 118 and 118'.

When the solenoids 142 and 142' are excited to cause the operating rods 141 and 141' to project, thereby pushing the side edges of the respective rod-like portions 140 and 140', disposed opposite to the serrations 118 and 118', the engaging members 116 and 116' are caused to move angularly toward the receiving members 117 and 117'. Thus, the serrations 118 and 118' are caused to engage respectively with the pawis 119 and 119' of the respective receiving members 117 and 117'.

On the sides of the respective solenoids 142 and 142' nearer to the gripper 138, columnar portions 143 and 143' for preventing the operating rods 141 and 141' from falling out are integrally provided on the side surface of the operating member 103.

In the following description, only one side of the scissors body 101 will be described with reference to the latch mechanisms 115 and 115', because the latch mechanisms 115 and 115' are symmetrical to each other on both sides of the scissors body 101.

In FIG. 7, when the scissors body 101 is operated by a hand in a direction in which the gripper 138 of the operating member 103 and the gripper 133 of the lever 108 are caused to approach each other, the lever 108 and the operating member 103 come to intersect with each other, and move angularly about a shaft of the bolt 109. Accordingly, the lever 108 is moved angularly with respect to the bolt 109 to serve as the shaft. Thus, the roller 110 at the forward end of the lever 108 is moved on the outside surface of the operating member 102 while being moved angularly to press the outside of the operating member 102.

Figure 15:
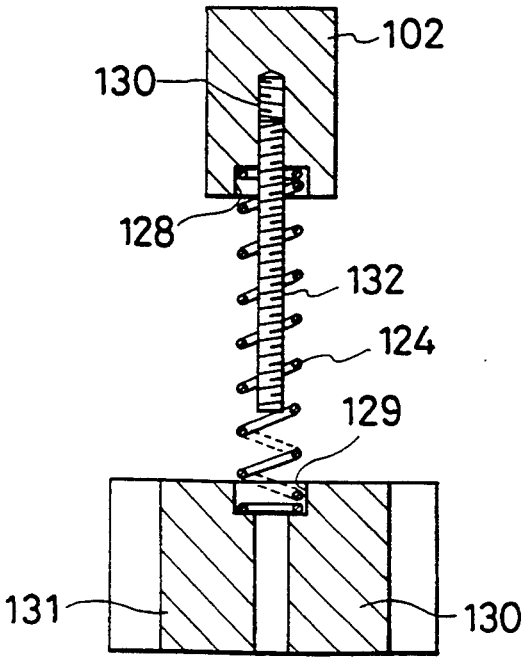
FIG. 15 is a cross-sectional view taken along a line K—K in FIG. 7.

In FIG. 15, the operating member 102 compresses the spring 124 against the biasing force thereof. This causes the forward end of the support rod 132 supporting the spring 124 to be guided by the guide bore 131 on the inside of the spring retainer 129 to be inserted into the guide bore 131, while, as shown in FIG. 11, the guide rod 125 is guided by the guide groove 126 so that the operating member 102 is moved parallelly toward the operating member 103, and the shearing blade 105 is moved toward the receiving portion 104.

Further, when the gripper 138 of the scissors body 101 and the gripper 133 of the lever 108 are released, the operating member 102 is pushed upward in a direction for separating from the operating member 103 due to the returning force of the compressed spring 124. This causes the operating member 102 to push the roller 110 upward, whereby the roller 110 moves angularly along the outside surface of the operating member 102, while the lever 108 moves angularly round the bolt 109 until the stopper 136 comes to abut against the side of the operating member 103.

When cutting the electric wire, the electric wire is placed intersecting with the shearing blade 105 between the shearing blade 105 of the operating member 102 and the receiving portion 104 of the operating member 103. The scissors body 101 is operated by the hand to move the gripper 138 of the operating member 103 and the gripper 138 of the lever 108 in the direction, in which they approach each other.

Figure 16:
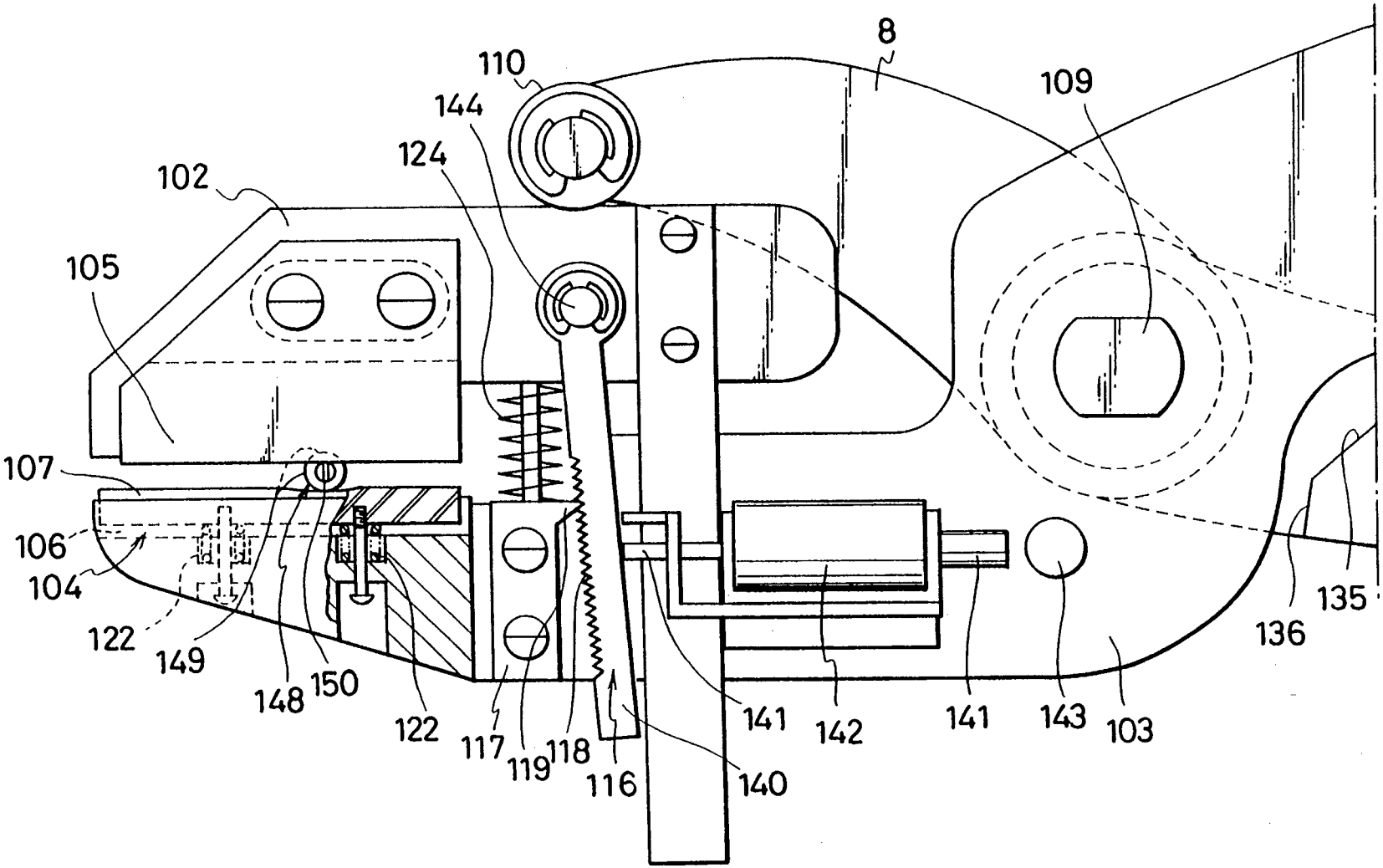
FIG. 16 is a front elevational view showing, in enlargement, a working or operating condition of a latch mechanism in the erroneous cutting prevention scissors according to the second embodiment of the invention.

As shown in FIG. 16, when the shearing blade 105 comes to abut against the electric wire 148 and is further pushed, the synthetic resin plate 107, whose bottom surface first has been moved toward the shearing blade 105 from the inner surface of the operating member 103 due to the biasing forces of the respective coil springs 122 and 122, is pressed against the electric wire 148 against the biasing forces of the respective coil springs 122 and 122 to sink into the receiving groove 106 in the operating member 103. Thus, the synthetic resin plate 107 is slightly deformed because of its own elasticity.

Thus, the electric wire 148 is moved toward the receiving portion 104 together with the synthetic resin plate 107. During the movement of the electric wire 148, the shearing blade 105 cuts the sheath 149 of the electric wire 148; however, since the biasing forces of the respective coil springs 122 and 122 are greater than the force by which the sheath of the electric wire 148 is cut, but is lower than the force by which the core 150 of the electric wire 148 is cut, the electric wire 148 is moved toward the operating member 103 together with the synthetic resin plate 107, thereby preventing the core 150 of the electric wire 148 from being cut at once.

For example, the load of the shearing blade 105 for cutting the sheath 149 of the electric wire 148 in this embodiment is about 50 g, while the load for cutting the core 150 is about 250 g.

When the electric wire 148 to be cut is alive, and the shearing blade 105 cuts the sheath 149 of the electric wire 148 until coming into contact with the core 150, the solenoid 142 is excited causing the operating rod 141 to project. Then, one side of the engaging member 116, which is opposite to the serration 118 of the rod-like portion 140, is pushed by the operating rod 141, causing engaging member 116 to be moved angularly toward the receiving member 117. This further causes setration 118 to engage with the pawl 119 of the receiving member 117. The operating member 102 and the operating member 103 are prevented from approaching each other when the engagement between the pawl 119 and the setration 118 of the engaging member 116 has occurred, thereby preventing the further movement of the shearing blade 105 so that the core 150 of live electric wire 148 can be prevented from being cut .

When the electric wire 148 to be cut is not alive, and even if the shearing blade 105 cuts the sheath 149 of the electric wire 148 until reaching the core 150, the latch mechanism 115 will not operate. Accordingly, in order to cut the wire, the gripper 138 of the operating member 103 and the gripper 133 of the lever 108 need to be moved in the direction, in which they are allowed to approach each other by the hand.

In the second embodiment, the elastic member is provided between the operating member 103 and the receiving portion 104. Instead, however, the shearing blade 105 may be made slidable with respect to the operating member 102, and an elastic member may be provided therebetween.

What is claimed is:

1. Erroneous cutting prevention scissors, comprising;

a first operating member including a shearing blade;

a second operating member including a receiving portion provided in a closable and separable manner with respect to said shearing blade;

detecting means for detecting a live condition of an electric wire when said shearing blade is in contact with a conductor of said electric wire;

a solenoid cooperating with said detecting means so as to be excited when said detecting means detects the live condition of said electric wire;

a first latch mechanism operated by excitation of said solenoid, provided on said first operating member and a second latch mechanism provided on the second operating member.

2. Erroneous cutting prevention scissors according to claim 1, wherein: the shearing blade of the first operating member extends in parallel with a receiving portion of the second operating member.

3. Erroneous cutting prevention scissors according to claim 1, wherein:

said receiving portion has a receiving groove for receiving said shearing blade.

4. Erroneous cutting prevention scissors according to claim 1, further comprising:

an elastic member deformable by a load with respect to the receiving portion of said shearing blade, provided between the first operating member and the receiving portion.

5. Erroneous cutting prevention scissors according to claim 4, wherein:

said elastic member comprises a coil spring.

6. Erroneous cutting prevention scissors according to claim 4, wherein:

said elastic member comprises a cushion comprising an elastic material.

7. Erroneous cutting prevention scissors according to claim 1, wherein:

respective solenoids and corresponding first and second latch mechanisms are provided on opposite sides of the first operating member and the second operating member.

8. Erroneous cutting prevention scissors according to claim 1, wherein:

the first and second latch mechanisms each include a receiving member having a pawl and an engaging member movable angularly toward said receiving member and having a serration engageable with said pawl.

9. Erroneous cutting prevention scissors according to claim 8, wherein:

the serrations of a first engaging member on one side of the first operating member and the serrations of a second engaging member on the other side of the first operating member are disposed to be offset from each other by a serration half pitch.

10. Erroneous cutting prevention scissors according to claim 1, wherein:

said first operating member is provided with the shearing blade, a coil spring fitted between the one and the other operating members, a support rod arranged in coincidence with an axis of said coil spring, and a guide member extending in parallel with said support rod, and the second operating member is provided with a receiving portion of said coil spring, a guide bore into which said support rod is guided and inserted, and a guide groove along which said guide member is guided.

11. Erroneous cutting prevention scissors according to claim 1, further comprising:

a roller abutting against an outside of said first operating member, axially supported by a forward end of said first operating member; and a lever provided to be extending to intersect with the second operating member and to be axially supported at an intermediate portion for being angularly movable therearound.

12. Erroneous cutting prevention scissors according to claim 11, wherein:

said lever is provided with a stopper abutting against one side of said second operating member.

* * * * *